United States Patent [19]

Ikeda et al.

[11] Patent Number: 4,818,669

[45] Date of Patent: Apr. 4, 1989

[54] SILVER HALIDE EMULSION

[75] Inventors: Hideo Ikeda; Shuzo Suga, both of Minamiashigara, Japan

[73] Assignee: Fuji Photo Film Co., Ltd., Minamiashigara, Japan

[21] Appl. No.: 857,063

[22] Filed: Apr. 29, 1986

[30] Foreign Application Priority Data

Apr. 30, 1985 [JP] Japan ..... 60-93328

[51] Int. Cl.[4] ..... G03C 1/02; G03C 1/08

[52] U.S. Cl. ..... 430/509; 430/523; 430/567; 430/607

[58] Field of Search ..... 430/567, 568, 598, 611, 430/502, 596, 509, 607, 523

[56] References Cited

U.S. PATENT DOCUMENTS

| | | | |
|---|---|---|---|
| 4,444,874 | 4/1984 | Silverman et al. | 430/409 |
| 4,452,882 | 6/1984 | Akimura et al. | 430/611 |
| 4,550,070 | 10/1985 | Miyasaka et al. | 430/598 |
| 4,728,596 | 3/1988 | Takaki et al. | 430/248 |

FOREIGN PATENT DOCUMENTS

| | | | |
|---|---|---|---|
| 2044944 | 10/1980 | United Kingdom | 430/567 |

*Primary Examiner*—Paul R. Michl
*Assistant Examiner*—Lee C. Wright
*Attorney, Agent, or Firm*—Burns, Doane, Swecker & Mathis

[57] ABSTRACT

This invention relates to a silver halide emulsion containing halogen conversion-type silver halide grains and light sensitive material comprising such as emulsion. The grains are selected from the group consisting of halogen conversion-type silver chlorobromide grains, halogen conversion-type silver iodobromide grains and halogen conversion-type chloroiodobromide grains, the grains having substantially no surface sensitivity, the average grain size thereof being not more than 0.30 micron, and the grains containing from 0 to 4 mol % of silver iodide.

The grains have particularly high ability to trap iodide ions so that light-sensitive material comprising the emulsion containing the grains have law dependence on formulation of developing solution and improved properties in connection with sensitivity, fog, gamma, maximum density.

9 Claims, 3 Drawing Sheets

( x 10,000) 1 μm

SILVER HALIDE EMULSION

BACKGROUND OF THE INVENTION (1) Field of the Invention

This invention relates to a novel silver halide emulsion which is able to produce highly sensitive silver halide photosensitive materials. More specifically, this invention relates to a novel emulsion containing halogen conversion-type silver halide fine grains.

(2) Description of the Prior Art

Halogen conversion-type emulsions have been known and prepared by, in the preparation of silver halide photographic emulsion, adding a halide enabling production of a silver halide having a smaller solubility product than that of hardly water soluble silver salt prepared in an aqueous solution to the aqueous solution, and thereby converting the halogen thereof into silver halide grains.

It is also well known that such halogen conversion-type emulsions are used as negative emulsions, positive emulsions, etc. and that the emulsions forms an internal latent image upon exposure. The emulsion enables development of a negative image upon treatment with an internal developing solution containing sodium thiosulfate and the like, followed by an imagewise exposure. Furthermore, it is well known to those skilled in the art that the emulsion directly forms a positive photosensitive material when treated with a developing solution in the presence of a fogging agent after imagewise exposure.

Halogen conversion-type emulsions are described in the specifications of Japanese Patent Pre-examined Publication (KOKAI) No. 18309/1977, KOKAI No. 30122/1981, Japanese Patent Publication No. 6090/1982 and etc. However, these specifications disclose processes for preparing a halogen conversion-type emulsion having good light response photographic properties such as sensitivity, gradation and maximum density, where the emulsion is treated with a general developer or specially treated by fogging development.

For example, Japanese KOKAI No. 18309/1977 discloses a halogen conversion-type emulsion which is prepared by conducting a precipitation reaction under the condition that hardly water soluble silver salts having a large solubility product are converted into hardly water soluble silver salts having a small solubility product, so that it provides an improved relationship between sensitivity and granularity of the emulsion as well as maximum density.

Japanese KOKAI No. 30122/1981 discloses a halide conversion-type emulsion containing grains having an average grain size of not more than 0.4μ, which is prepared by conducting halogen conversion reaction at high temperature (for example 70° C.) between silver chloride emulsion or silver chlorobromide emulsion and bromide or a mixture of bromide and iodide, after which chemical sensitization is carried out under special conditions, so that it provides an improvement in the sensitivity of the emulsion.

This Japanese Patent Publication also discloses that, bromide, iodide or a mixture thereof is added thereto within 20 minutes after formation of silver halide grains containing no silver iodine, thereby controlling physical ripening while controlling the growth of silver halide grains in order to prepare a high sensitive emulsion containing fine grains.

Furthermore, halogen conversion-type emulsions have been known from publications other than the above patents. For example, U.S. Pat. No. 2,592,250 discloses a halogen conversion-type silver chloroiodobromide emulsion containing at least 6 mol% of silver iodide in which silver chloride is converted by bromide and iodide. This patent can provide a silver halide emulsion enabling formation of a latent image at the interior.

On the other hand, as a rule, a silver halide containing silver iodide has been used in highly sensitive silver halide photographic materials. However, when the development is carried out in the presence of iodide such that the photographic material per se contains iodide as described above or a developing solution contains iodide, problems arise in that many changes occur in respect of photographic characters and image quality.

The above problems may, for example, result from the removal of iodide ion between silver halide grains in the same emulsion layer or other layers, or the irrigation of iodide ions from the developer to silver halide grains in the coating layer of the photographic layer.

Accordingly, there have been desired techniques for effectively trapping iodide ions. Such an effect cannot be adequately achieved by the halogen conversion-type emulsion described in the above patent specifications.

SUMMARY OF THE INVENTION

It is therefore a primary object of this invention to provide a halogen conversion-type emulsion containing novel silver halide fine grains and having substantially no surface photosensitivity.

Another object of this invention is to provide a halogen conversion-type emulsion having large ability to trap iodide ions.

Another object of this invention is to provide a novel photographic light-sensitive material containing a halogen conversion-type emulsion having large ability to trap iodide ions, and photographic silver halide grains.

These and other objects of this invention will be clear from the following description.

The objects of this invention can be attained by a silver halide emulsion comprising halogen conversion-type grains selected from the group consisting of halogen conversion-type silver chlorobromide grains, halogen conversion-type silver iodobromide grains and halogen conversion-type chloroiodobromide grains, the grains having substantially no surface sensitivity, the average grain size thereof being not more than 0.30μ, and the grains containing from 0 to 4 mol% of silver iodide.

DESCRIPTION OF THE PREFERRED EMBODIMENTS

Figure 1:
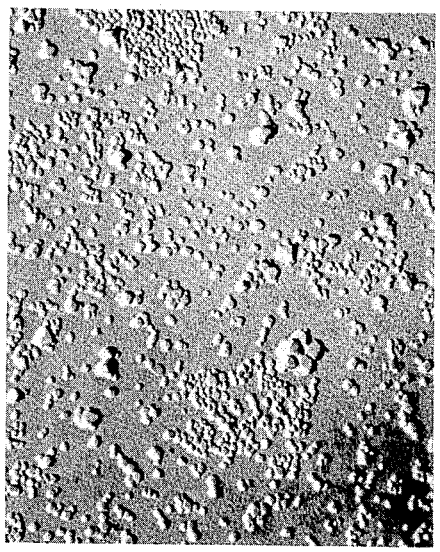
FIG. 1 is an electron micrograph showing the structure of silver halide grains contained in a halogen conversion-type emulsion 5 of this invention prepared in Example 1.

The ability to trap iodide ions, which the silver halide emulsion of this invention has, can be measured by a method of following the emulsion current variation directly after iodide is added to the emulsion, or alternatively, by another method involving detecting, (for example by a direct X-ray fluorometry) the iodide ions taken up in the emulsion upon immersing a sample coated with the emulsion in iodide solution. The former method is based on the following principle. Namely, when iodide is added to an emulsion containing a small amount of silver iodide, halogen conversion reaction occurs so that the ratio of iodide ion, bromide ion and chloride ion in the solution is changed. A change of the ratio among halide ion kinds in the solution results in a change in the silver ion concentration of the solution since the solubility product of silver ion and halide ion depends on the kind of halide ion. The silver ion concentration can be detected by measuring the potential at the interface between the solution and a silver rod against a reference electrode. Thus, the rate of iodide ion trap occuring to the halogen conversion can be detected by following the current variation of the emulsion solution. Where the emulsion has large iodide ion trapping power, the current shifts to the positive direction more rapidly, after which the current maintains a constant value. In this connection, refer to, for example, James: The Theory of the Photographic Process, 4th edition, chapter 1, published by McMillan Co., in 1966 and J. Phot. Sei., vol 24 (4) pages 142 to 147 (1976).

It is desirable for the halogen conversion-type grains of this invention to have the following properties in connection with developing properties.

Namely, when the halogen conversion-type grains are to be exposed to light sufficiently to saturate the optical density obtained by developing at 20° C. for 4 minutes with an internal developing solution prepared by adding 0.3 g/l of KI to the following surface developing solution, the halogen conversion-type grains have such properties that there can be obtained not more than 50%, preferably not more than 30%, more preferably not more than 20%, of the optical density obtained by said development where a development is carried out at a temperature of 20° C. for 4 minutes with the following surface developing solution.

Composition of surface developing solution

N-methyl-p-aminophenol sulfate—0.31 g
sodium thiosulfate—39.6 g
hydroquinone—6 g
sodium carbonate—18.7 g
potassium bromide—0.86 g
citric acid—0.68 g
potassium metabisulfite—1.5 g Total volume of the solution is adjusted to 1 l by adding water to the above components.

In this invention "halogen conversion-type grains having substantially no surface sensitivity" are defined as the grains which do not directly contribute to image forming in a case where the grains are treated by a general surface developing solution, for example, the surface developing solution described above. Where photographic light-sensitive materials are prepared by using the halogen conversion-type emulsion of this invention, it is also defined by that the grains result in a photographic emulsion having a sensitivity of not more than 1/10, preferably not more than 1/100, compared with the sensitivity obtained by developing other light-sensitive silver halide emulsions of photographic light-sensitive materials with a surface developing solution.

A process for preparing a silver halide emulsion of this invention is described hereunder.

In the first stage, silver halide grains are formed according to the publicly known process.

Namely, the grains can be prepared by the methods described in, e.g., P. Glafkides, Chimie et Physique Photographique (Paul Montel, 1967); G. F. Duffin, Photographic Emulsion Chemistry (The Focal Press, 1966); and V. L. Zelikman et al., Making and Coating Photographic Emulsion (The Focal Press. 1964). In this connection, reaction between a soluble silver salt and a soluble halide salt can be carried out by any of the single jet method, double jet method or a combination thereof.

A process for the formation of grains in the presence of excess silver ions (the so-called reverse mixing process) can also be used. A process in which a pAg in a liquid phase in which silver halide is formed is kept constant, which is one of the simultaneous mixing processes and which is the so-called controlled double jet process, can be used.

According to this process, silver halide grains having regular crystal form and nearly uniform grain size (monodispersed emulsion) can be obtained.

A mixture of two or more kinds of silver halide grains which have been separately or differently prepared may be used.

During the formation or physical ripening of silver halide grains, there may be allowed to coexist cadmium salts, zinc salts, lead salts, thallium salts, iridium salts or complex salts thereof, rhodium salts or complex salts thereof, iron salts or complex salts thereof, etc.

At this first stage, it is preferable that the average grain size of the silver halide grains thus prepared be not more than 0.3$\mu$, preferably 0.3 to 0.01$\mu$, more preferably 0.2 to 0.02$\mu$.

In order to prepare such silver halide fine grains, it is preferable to set the condition of the process so as not to form silver halide grains having large grain size. For example, it is preferable to employ a low reaction temperature, in particular one not more than 50° C., more preferably 50° to 0° C.

On the other hand, as for silver halide solvents such as ammonia and thioether, these must not be used in such amount that the grain size of the silver halide grains is increased.

It is also preferable to form silver halide grains in the presence of a hydrophilic colloid such as gelatin for the reason that this makes grain size thereof small. In this case, it is more preferable to make the concentration of the hydrophilic colloid high. In addition, it is preferable to form the grains under a PH condition in which the protective colloidal properties of gelatin are increased. In a case where gelatin or the like is used, the grains can be formed with pH lowered by using acids (preferable PH being 2 to 10). It is also preferable that gelatin concentration be 0.2 to 10 wt%.

Furthermore, it is preferable that the excess amount of halide ions to silver ions during the formation of the precipitation be maintained near the amount which minimizes solubility of AgCl grains. In a case where bromide is used, the amount thereof firstly added to the reaction container should be limited to such amount that assures that a twin crystal is not formed at least during addition of soluble silver salts thereto. Bromide can be added thereto after the addition of soluble silver salts is completed.

In the case where iodide is used, it may be added to the container at first, together with addition of soluble silver salts or after the addition of the same is completed if the amount of iodide is from 0 to 4 mol%.

Any kind of silver halide prepared in the first stage can be used. Such silver halide may include silver chloride, silver chlorobromide and silver chloroiodobromide. As for the halide composition, it preferably comprises 50 to 100 mol% of silver chloride, 0 to 50 mol% of silver bromide and 0 to 4 mol% of silver iodide.

The silver halide may be of any shape, for example cubic, octahedral, tetradecaheral, rhomdodecahedral, or spherical. A typical example of such a shape is cubic.

At the second stage of this process, silver halide prepared in the first stage is converted to hardly watersoluble silver halide having a smaller solubility product.

In this case it is preferable to convert not less than 50 mol% of the halogen contained in the silver halide prepared in the first stage with bromide and/or iodide. The conversion ratio may not be less than 60 mol%, further not less than 70 mol%, the conversion ratio can be easily controlled by adding an amount of an aqueous solution containing iodide and/or bromide.

In this connection, it is preferable to start the second stage in a short time, for example within at least within 30 minutes after the silver halide emulsion is prepared in the first stage, keeping the reaction temperature not higher than 50° C. The reaction of the second stage may be conducted according to any of (a) a method in which silver halide emulsion prepared in the first stage is added to an aqueous solution containing bromide or a mixture of bromide and iodide, (b) the reverse of the aforesaid method, or (c) another method in which the emulsion and the aqueous solution are simultaneously charged into an empty reaction vessel.

It is also preferable that the concentration of bromide or a mixture of bromide and iodide contained in the aqueous solution be as low as possible, for example not higher than 5 wt%.

During or after the second stage, soluble silver salts may be added thereto in such amount that the properties of the emulsion of this invention are not impaired.

In the third stage of this process, excess halogen salts and other soluble salts are removed therefrom. For such removal, there can be employed the traditional Noodle washing method in which gelatin is gelatinized or a flocculation method using inorganic salts consisting of polyanion, for example, sodium sulfate; anionic surface active agents; anionic polymer, for example, polystyrene sulfonic acid; gelatin derivatives, for example, aliphatic acylated zelatin, aromatic acylated gelatin, aromatic carbamoyl gelatin. The step of such removal may be omitted.

It is preferable to carry out the third stage as fast as possible after the second stage is completed from the point of stability of the silver halide grains, and to lower the concentration of the excess halogen salts to not more than 1/5 with 1 hour. After the third stage, if desired, there can be added any of various chemical compounds such as a stabilizer thereto or to expose the silver halide grains to light.

This third stage may, if necessary, be conducted after the first stage and before second stage.

In the halogen composition of the halogen conversion-type emulsion according to this invention, the silver iodide content is from 0 to 4 mol%, preferably 0 to 2 mol%.

The silver chloride content is preferably 0 to 50 mol% and the silver bromide content is preferably 50 to 100 mol%.

Furthermore, the average grain size of the silver halide contained in the halogen conversion-type emulsion of this invention is not more than 0.30μ. Otherwise, the iodide ion trapping power decreases. Silver halide grains having a grain size not larger than the average grain size thereof are preferable. In particular, a grain size of not more than 0.20μ is preferable in connection with iodide ion trapping ability and the like.

Since it is not preferable to include silver halide grains having an extremely large grain size in the emulsion of this invention, the maximum grain size thereof is preferably not more than 0.6μ, more preferably not more than 0.4μ. In any case it is preferable that the shape of the grains be spherical or platelike.

The grain size destribution may be wide or narrow. In a case where the distribution is narrow, the coefficient of variation may be not more than 20%, further not more than 10%.

"Average grain size" as used in this specification has the meaning ordinarily assigned thereto the field of silver halide photosensitive materials. More exactly, "average grain size" means the average size of silver halide grains contained in the emulsion, which is determined based on grain diameter where the grains are spherical or approximately spherical, or which is determined based on ridge length$\times\sqrt{4/\pi}$ where the grains are cubic. These determinations are referred to in, for example, James, The Theory of the Photographic Process, 3rd edition, pages 36 to 43 (MacMillan 1966) and The Society of Photographic Science and Technology of Japan editing; Basis of Photographic Technology (Silver Halide Photography), pages 277 to 278.

The emulsion of this invention is generally used without being chemically sensitized. However, the emulsion may be chemically sensitized as far as the iodide ion trapping ability is not reduced.

The chemical sensitization may be carried out according to, for example, a method described in H. Frieser, Die Grundlagen der Photographischen Prozesse mit Silber—halogeniden (Akademische Verlagsgesellschaft, 1968) pages 675 to 734.

Various kinds of chemical compounds may be added to the photographic emulsion of this invention in order prevent fog during preparation, preservation, photographic processing of the photosensitive material, or to stabilize the photographic properties thereof. Namely, there can be used many compounds known as antifoggants and stabilizers such as thiozoles, for example benzothiazolium salt, benzimidazolium salt, imidazoles, benzimidazoles (preferably 5-nitrobenzimidazoles), nitroindazoles, benzotriazoles (preferably 5-methyl benzotriazoles), triazoles etc.; mercapto compounds, for example mercaptothiazoles, mercaptobenzothiazoles, mercaptobenzimidazoles, mercaptobenzoxazoles {in particular, a compound having the following general formula (I):

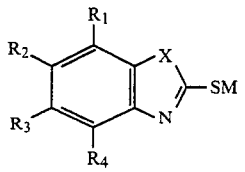

where X represents —O—, —NH— or —S—; $R_1$, $R_2$, $R_3$ and $R_4$ represent hydrogen atom or a substituent, and at least one of $R_1$, $R_2$, $R_3$ and $R_4$ is substituted or unsubstituted alkyl or substituted or unsubstituted aryl group having up to 13 carbon atoms, which is bonded directly or through a divalent linkage group, to the aromatic nucleus; M represents hydrogen atom, alkali metal or $NH_3$; these compounds are described in Japanese Patent Application No. 170588/1984 (U.S. Ser. No. 765,238)}, mercaptooxadiazoles, mercaptothiadiazoles, mercaptotriazoles, mercaptotetrazoles (in particular 1-phenyl-5-mercaptotetrazole etc.), mercaptopyrimidines, mercaptotriazines, etc.; thiocarbonyl compounds, for example oxazolinethio; azaindenes, for example triazoindenes, tetraazaindenes (in particular 4-hydroxy-6-methyl-(1,3,3a,7)tetraazaindene), pentaazaindenes, etc.; benzenethiosulfonic acids, benzenesulfinic acids, benzene sulfonic amids; purines, for example adenine.

Although it is convenient to use gelatin as a binder or a stabilizer added to the emulsion of this invention, other hydrophilic colloids can also be used.

Any of a lime-processed gelatin, an acid-processing gelatin, gelatin derivatives or the like can be used.

The halogen conversion-type emulsion of this invention can be used in various manners to make a direct contribution to image forming as a photographic emulsion, to say nothing of only using it for trapping iodide ions.

Typical embodiments of this invention are explained in detail hereunder.

(1) The halogen conversion-type emulsion of this invention is used as a sublayer such as a surface protective layer or an interlayer, or silver halide emulsion layer, so as to enable trap of unnecessary iodide ions. Thereby it can lower the dependence based on iodide ion concentration of the developing solution and prevent eluation and removal of iodide ions from emulsion layer to developing solution or another emulsion layer in order to make minimize variation in photographic properties.

The coating amount of the emulsion of this invention is not particularly limited, but it is desirable to coat generally in an amount of $1\times10^{-6}$ mol/m$^2$ to $1\times10^{-2}$ mol/m$^2$, preferably $1\times10^{-4}$ to $1\times10^{-2}$ mol/m$^2$. It is also preferable to adjust the coated silver amount to 0.2–20 weight %, in particular 0.7–7 weight % relative to the total amount of photosensitive silver halide coated thereon.

(2) There can be obtained improved photographic properties, for example, prevention of fog, granularity and the like, by adding the emulsion of this invention to a light-sensitive silver halide emulsion layer containing large amount of AgI (for example from 3 to 15 mol%) or to a layer located close to such emulsion layer.

This addition is particularly preferable in case where the photosensitive materials are processed with a developing solution containing dialdehyde hardening agent. Such case is described in detail in, for example Japanese Patent Pre-examined Publication (KOKAI) No. 76737/1985 etc.

The ratio of said silver halide photosensitive emulsion to the emulsion of this invention can be varied on the basis of the AgI content of said photosensitive emulsion, kind of photosensitive material, usage thereof or etc., whereas the ratio is preferably 100:1 to 1:1, more preferably 50:1 to 4:1. It is also preferable that the total coated silver amount be 0.5 to 10 g/m$^2$.

(3) Fog nuclei can be formed in the interior of the emulsion of this invention by a light irradiation method or a method in which the emulsion in chemically fogged, followed by bleaching the surface of grains contained in the emulsion, and thereafter the emulsion is used together with the photosensitive silver halide emulsion containing AgI (in the same emulsion layer or an emulsion layer located close to the layer containing the photosensitive emulsion) in order to form an image.

By such usage, there can be obtained high-speed silver halide photographic light-sensitive materials which give an image having high maximum density.

In this connection, it is preferable that the emulsion of this invention have substantially no sensitivity.

The above-mentioned usage is described in detail in U.S. Pat. Nos. 2,996,382, 3,398,987, 4,459,351, Japanese Patent Pre-examined Publication (KOKAI) Nos. 215647/1983, 86039/1984, 100438/1984, 147350/1984 etc.

The ratio of said photosensitive silver halide to the emulsion of this invention of which the interior is fogged can be varied on the basis of the emulsion type (for example, halogen composition), kind of photosensitive material, usage thereof or contrast of the emulsion, whereas the ratio is preferably 100:1 to 1:100, more preferably 10:1 to 1:10. It is also preferable that the total coated silver amount be 0.5 to 10 g/m$^2$.

If desired, a light-sensitive silver halide emulsion layer or, a sublayer (intermediate layer, protective layer etc.) may be employed in preparation of photographic light-sensitive material containing the emulsion of this invention. In this case, conventional layers can be employed as the above mentioned layers. The above light-sensitive silver halide emulsion can be prepared according to well-known methods.

Namely, the photographic emulsion can be prepared by the methods described in, e.g., P. Glafkides, Chimie et Physique Photographique (Paul Montel, 1967); G. F. Duffin, Photographic Emulsion Chemistry (The Focal Press, 1966); and V. L. Zelikman et al., Making and Coating Photographic Emulsion (The Focal Press. 1964).

The resulting emulsions are usually chemically sensitized. For the chemical sensitization, there may, for example, be used the method as described in H. Frieser, Die Grundlagen der Photographischen Prozesse mit Silber-halogeniden (Akademische Verlagsgesellschaft, 1968) pages 675 to 734.

The light-sensitive silver halide photographic emulsions may contain various kinds of additives beside the above described agents. For example, there can be used antifoggants, stabilizers, couplers, fluorescent brighteners, dyes, spectral sensitizers, desennsitizes, hardening agents, coating aids, antistatic agents, plasticizers, lubricants, watt agents, development accelerators, oil mordants, U. V absorbers, antidecolorating agents, color antifoggants, mildewproofing agents and the like. These agents are concretely described in Research Disclosure 176, pages 22 to 31 (RD-17643 (December 1978) etc.

In the photographic light-sensitive materials using this invention, photographic emulsion layers and other layers are coated on one or both sides of a flexible support which is usually used in this technical field. Examples of suitable flexible supports include films of synthetic polymers such as cellulose acetate, cellulose acetobutyrate, polystyrene or polyethylene terephthalate, a laryta paper, a paper coated or laminated thereon α-olefin polymer (e.g., polyethylene, polypropylene, ethylene-butene copolymer) on the like.

In the photographic light-sensitive material, photographic emulsion layers and other hydrophilic colloid layers may be coated on a support or other layer according to various conventional coating methods. Examples of such coating methods include dipping, roll coating, curtain coating, extrusion coating, etc.

The emulsion of this invention may be applied to any photographic light-sensitive material. For example, it may be applied to photographic light-sensitive materials for printing plates (Lith-type film, scanner film etc.), X-ray photographic light-sensitive materials (direct or indirect medical use, industrial use, etc.), black-and-white negative films, black-and-white photographic papers, microphotosensitive material (for COM, microfilm, etc.), color negative films (general use, movie use, etc.), reversal color films (for slides, movies, etc.; the films may or may not contain couplers), color photographic papers, color positive films (for movies, etc.), reversal color photographic papers, color light-sensitive for heat development, color light-sensitive materials for silver dye bleach.

In case where the halogen conversion-type grains of this invention are applied to color photographic light-sensitive materials, the grains may be contained in one or more emulsion layers of conventional color photographic light-sensitive materials. As a rule, such conventional color photographic light-sensitive materials are basically formed by providing in order of red sensitive emulsion layer, green sensitive emulsion layer and blue sensitive emulsion layer on the support. In the color photographic paper, such layers may be provided in reverse order. In either case, each emulsion layers may be constituted of two layers or three layers. Beside the above emulsion layers, there may generally be provided a protective layer (as a single layer or double layer) or intermediate layer, if necessary, yellow filter layer, antihalation layer, etc.

Photographic processing of the light-sensitive material of this invention may be carried out by any conventional processing, using conventional processing solutions. The processing may usually be carried out at a temperature between 18° and 50° C., whereas it may also be carried out at a temperature lower than 18° C. or higher than 50° C. There can be employed either a developing treatment for forming a silver image (black-and-white photographic processing) or color photographic processing consisting of a developing treatment for forming a color image, depending on purpose.

As for black-and-white developing solutions, these can be used singly or in combination with conventional developing agents such as dihydroxybenzenes (e.g., hydroquinone), 3-pyrazolidones (e.g., 1-phenyl-3-pyrazolidone), aminophenols (e.g., N-methyl-p-aminophenol), and the like. The developing solution may also contain silver halide solvents (e.g., thioethers, thiazole compounds, thiocyanate, imidazoles, etc.), antifoggants (triazoles, benzimidazoles etc.), preservatives, alkali agents, pH buffers and if necessary, may further contain dissolving aids, toning agents, development accelerators, surface active agents, deforming agents, water-softening agents, hardeners, thickeners, etc.

As a rule, the color developing solution consists of alkali aqueous solution comprising color developing agents. As for the color developing agents, there may be used well-known aromatic primary amine developing agents, for example, phenylene diamines (e.g., 4-amino-N,N-diethylaniline, 3-methyl-4-amino-N,N-diethylaniline, 4-amino-N-ethyl-N-betahydroxyethylaniline, 3-methyl-4-amino-N-ethyl-N-betahydroxyethylaniline, 3-methyl-4-amino-N-ethyl-N-betamethanesulfoamido ethylaniline, 4-amino-3-methyl-N-ethyl-N-beta-methoxyethylaniline, etc.).

In addition, there may also be used compounds described in L. F. A. Mason, Photographic Processing Chemistry, pages 266 to 229 (Focal Press. 1966), U.S. Pat. Nos. 2,193,015, 2,592,364, Japanese Patent Pre-examined Publication (KOKAI) No. 64933/1973 etc.

Furthermore, the developing solutions may contain pH buffers such as alkali metal sulfites, carbonates, borates and phosphates, developing restrainers such as bromides, iodides and organic antifoggants, or antifoggants. If necessary, the developing solutions may also contain water-softening agents, preservatives such as hydroxyl amines, organic solvents such as benzyl alcohol and diethylene glycol, development accelerators such as polyethylene glycol, quaternary ammonium salts and amines, dye forming couplers, competing couplers, fogging agents such as sodium boron hydride, auxiliary developing solution developing agents such as 1-phenyl-3-pyrazolidone, thickeners, polycarboxylic chelating agents described in U.S. Pat. No. 4,083,723 and anti-oxidizing agents described in OLS No. 2,622,950.

A special type development may also be applied to the photographic materials, in which a developing agent is included in the photographic materials, for example, in the emulsion layer and the photographic materials is processed in an aqueous alkaline solution. Among developing agents, the hydrophobic one can be introduced in the emulsion layer according to various methods as described in Research Disclosure, No. 169 (RD-16928), U.S. Pat. No. 2,739,890, British Pat. No. 813,253 or West German Pat. No. 1,547,763. Such development processing may be combined with a processing for stabilizing silver salt with thiocyanates.

As fixing agents, those having a commonly used forumulation can be employed. Examples of such fixing agents which can be used include, in addition to thiosulfates and thiocyanates, organic sulfur-containing compounds which are useful as a fixing agent. The fixing agents may contain water soluble aluminum salts as a hardener.

this invention will now be explained in more detail with reference to the following examples.

EXAMPLE 1

Processes for preparation of halogen conversion-type emulsions having various halogen compositions and average grain sizes are shown in this example.

An aqueous solution of 1.38 mol of KCl and another aqueous solution of 1,18 mol of $AgNO_3$ were added over one and half minutes to an aqueous solution of an inert gelatin and 0.27 mol of KCl, by the double-jet method. When one minute had passed after the addition was completed, an aqueous solution of 1.38 mol of KBr and 0.12 mol of KI for halogen conversion were added thereto, and was left to stand for 20 minutes. The above procedure was conducted at a temperature of 45° C. The resulting mixture was then de-salted by a conventional flocculation method and thereafter gelatin was added thereto in the required amount to prepare a comparative emulsion No. 1.

A comparative emulsion No. 2 was prepared according to the same process as that for preparing comparative emulsion No. 1, except that an aqueous solution of 1.46 mol of KBr and 0.035 mol of KI was used as the aqueous solution for halogen conversion.

A comparative emulsion No. 3 was prepared according to the same process as that for preparing comparative emulsion No. 1, except that an aqueous solution of 1.50 mol of KBr was used as the aqueous solution for halogen conversion.

A comparative emulsion No. 4 was prepared according to the same process as that for preparing the emulsion No. 1, except that an aqueous solution of 1.08 mol of KBr was used as the aqueous solution for halogen conversion.

An emulsion No. 5 of this invention was prepared as follows. An aqueous solution of 1.50 mol of NaCl and another aqueous solution of 1.18 mol of $AgNO_3$ were added over 5 minutes to an aqueous solution of an inert gelatin, 0.03 mol of NaCl and a small amount of acetic acid, by the double-jet method. When one and half minutes had passed after the addition was completed, the resulting emulsion was mixed with an aqueous solution of 1.09 mol of KBr and 0.024 mol of KI for halogen conversion, and was left to stand for 20 minutes. The above procedure was conducted at a temperature of 42° C. The resulting emulsion was then de-salted by a conventional flocculation method and thereafter gelatin was added thereto in the required amount.

An emulsion of this invention No. 6 was prepared according to the same process as that for preparing emulsion No. 5, except that an aqueous solution of an inert gelatin, 0.02 mol of KBr and small amount of sulfuric acid was used as the aqueous solution; an aqueous solution of 0.024 mol of KI was added thereto 30 seconds after addition of the two aqueous solutions was completed; an aqueous solution of 1.18 mol of KBr was used as the aqueous solution for halogen conversion; and the overall process was conducted at a temperature of 40° C.

An emulsion of this invention No. 7 was prepared according to the same process as that for preparing emulsion No. 5, except that an aqueous solution of 1.20 mol of KBr was used as the solution for halogen conversion and the overall process was conducted at a temperature of 38° C.

An emulsion No. 8 was prepared according to the same process as that for preparing emulsion No. 7, except that the overall process was conducted at a temperature of 48° C.

The thus obtained halogen conversion-type emulsions Nos. 1 to 7 were observed with an electron microscope, and the average grain sizes were measured. The halogen compositions thereof were determined by X-ray-fluorometry. The results thus obtained are shown in Table 1.

TABLE 1

| Emulsion No. | Composition of silver halide grains* Silver iodide content (mol %) | Silver chloride content (mol %) | Average grain size (μm) | |
|---|---|---|---|---|
| 1 | 10 | 0 | 0.16 | Comparative example |
| 2 | 3 | 0 | 0.33 | Comparative example |
| 3 | 0 | 0 | 0.39 | Comparative example |
| 4 | 0 | 10 | 0.38 | Comparative example |
| 5 | 2 | 7 | 0.12 | Present invention |
| 6 | 2 | 0 | 0.14 | Present invention |
| 7 | 0 | 1 | 0.13 | Present invention |
| 8 | 0 | 1 | 0.25 | Present invention |

*Numerical makes rounded off to nearest integer.

EXAMPLE 2

This example shows that the emulsion of this invention is able to easily trap additive ions.

Emulsions Nos. 9 to 11 were prepared as follows, in order to compare them with emulsion No. 7 described in example 1.

An emulsion No. 9 was prepared according to the same process as that for preparing emulsion No. 7, except that 2 cc of 25% $NH_3$ aqueous solution was used instead of acetic acid.

An emulsion No. 10 was prepared according to a common controlled double-jet method, in which an aqueous solution of 1.18 mol of $AgNO_3$ and another aqueous solution of a mixture of KBr and NaCl were added over 50 minutes, maintaining a pAg of 9.4 and a temperature of 40° C. The resulting emulsion was then desalted by a conventional flocculation method, and thereafter the ratio of gelatin amount to silver halide, the pAg and the pH of the emulsion were adjusted to those of emulsion No. 7.

An emulsion No. 11 was prepared according to the same process as that for preparing emulsion No. 10, except that 1.5 cc of 25% $NH_3$ aqueous solution was used and the reaction was conducted at a temperature of 65° C.

The average grain sizes and halogen compositions of the emulsions are summarized in Table 2. The sizes were determined by electron micrography and the compositions were determined by X ray-fluorometry. The crystalline phases of emulsions Nos. 7 and 9 to 11 were all similar, nearly spherical.

TABLE 2

| Emulsion No. | Type of process for preparation of emulsion | Composition of silver chlorobromide Silver chloride content (mol %) | Average grain size (μm) | |
|---|---|---|---|---|
| 7 | Halogen conversion | 1 | 0.13 | Present invention |
| 9 | Halogen conversion | 1 | 0.37 | Comparative example |
| 10 | Controlled double-jet method | 1 | 0.12 | Comparative example |
| 11 | Controlled double-jet method | 1 | 0.38 | Comparative example |

Figure 2:
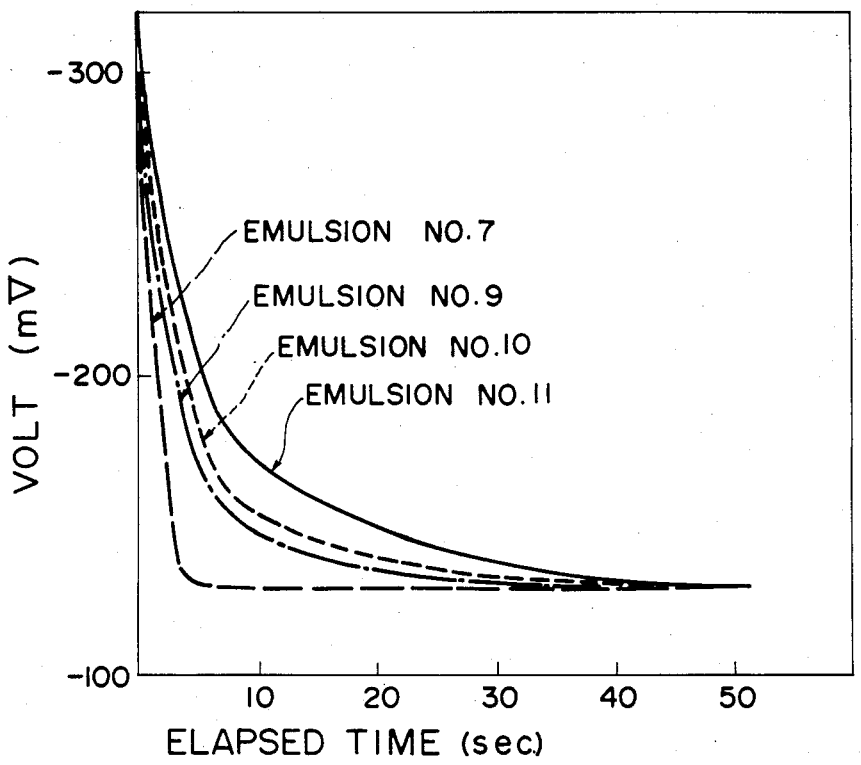
FIG. 2 shows the iodide ion trapping abilities of emulsions Nos. 7, 9, 10 and 11 in Example 2, in which the vertical axis of the figure is graduated in volts [mV] and the horizontal axis is graduated in time units [sec] after the emulsion and KI solution were mixed.

50 g of each of emulsions Nos. 7 and 9 to 11 having the same halogen composition and same grain size prepared by different methods was charged in a container and dissolved in water at a temperature of 40° C. KI solution corresponding to half amount of the silver halide contained in 50 g of the above emulsion was then added to each container instantaneously. Speed variation in conversion reaction at that time was followed using a silver rod and a saturated calomel reference electrode. The results obtained are shown in FIG. 2. As is obvious for this figure, the emulsion of this invention can trap iodide ions more easily than comparative emulsions Nos. 9 to 11.

Samples 1 and 2 were prepared by coating each of emulsions 7 and 10 on a polyester support. In this case, the coated silver amount of both samples was 6.0 g/m$^2$ and the coated gelatin amount thereon was 3.8 g/m$^2$.

Figure 3:
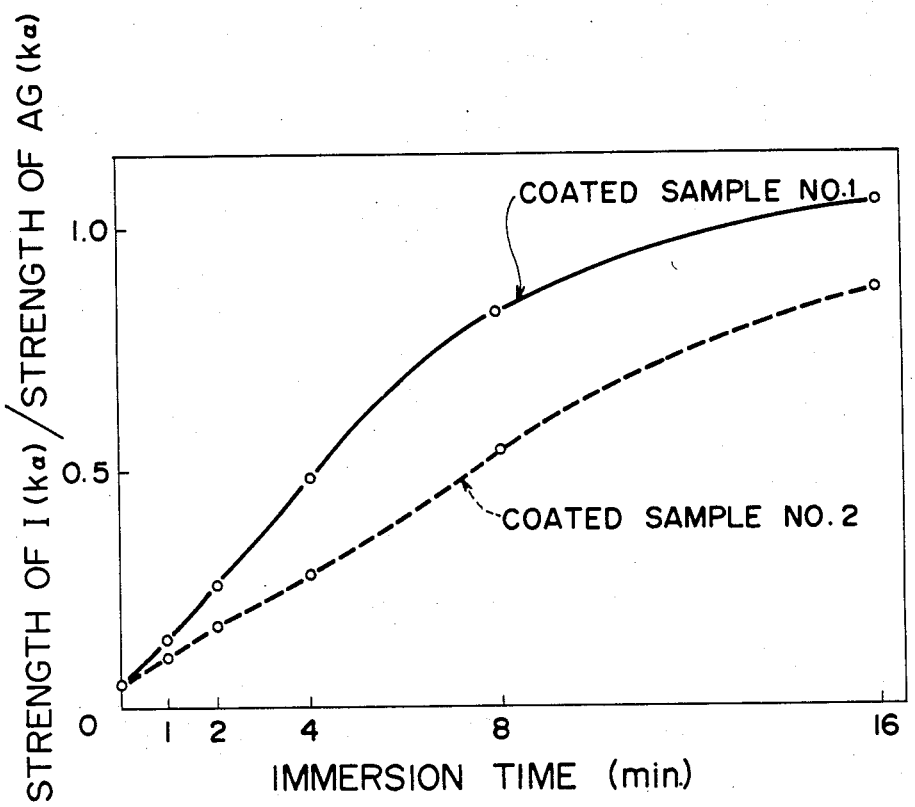
FIG. 3 shows the trapping iodide ion abilities of coated samples Nos. 1 and 2 in which the vertical axis represents the relative strength ratio of iodine atom to silver atom contained in the samples and the horizontal axis represents the period (minutes) the samples were kept immersed in KI solution.

Samples cut from coated samples 1 and 2 were immersed in KI solution containing 1.7 g/l of KI at a temperature of 20° C. for 1, 2, 4, 8 or 16 minutes, followed by sufficient washing and drying, after the relative strength ratio of iodine atoms to silver atoms in the samples was measured by X-ray analysis. $K_\alpha$ ray of Gb was used as the incident ray, and $k_\alpha$ ray of Ag and $K_\alpha$ ray of I were used for detection. The results obtained are shown in FIG. 3. As is also obvious form this figure, the emulsion of this invention can easily trap iodide ions.

EXAMPLE 3

This example shows the effects obtained by having the emulsion of this invention contained in a light-sensitive silver halide emulsion layer in which the contained silver halide grains have not less than 3 mol% of AgI.

Keeping the KBr concentration relatively high in the container in which halogen and gelatin had been charged before the reaction started, the emulsion was prepared from silver nitrate aqueous solution, potassium bromide aqueous solution and potassium iodide aqueous solution according to a conventional ammonia method. The resulting emulsion contained thick platelike silver iodobromide grains and having an average grain size of 1.0μ (AgI equal to 4 mol%). The emulsion was then washed by a conventional method, after which it as chemically sensitized according to the gold-sulfur sensitization method using chloroauric acid and sodium thiosulfate. In addition, 4-hydroxy-6-methyl-1,3,3a,7-tetraazaindene was added thereto as a stabilizer in order to prepare a photosensitive Ag $Br_{0.96}I_{0.04}$ emulsion No. 12. 8 samples of the emulsion were prepared in amounts of 50° g each. Gelatin only was added to one sample while 10 g of emulsion No. 1, 3, 6, 7, 9, 10 or 11 prepared in example 1 and 2 were added to the other 7 samples, respectively. The amount of gelatin added to the first sample was similar to the amount of gelatin contained in the 10 g of emulsion added to the other samples. All emulsions used here were adjusted to the same mol number of silver halide per weight. Sodium dodecyl benzen sulfonate (coating aid), poly-potassium p-vinylbenzene sulfonate (thickening agent) and N,N'-ethylenebis(vinylsulfonyl acetoamido) (hardener) were added to these emulsions to prepare coating solutions. Such solutions and gelatine aqueous solution were separately coated in order on a polyester support previously undercoated, to obtain coated samples Nos. 3 to 10. In this case, the coated silver amount of emulsion No. 11 was 2.5 g/m$^2$ in all samples and those of emulsion Nos. 1, 3, 6, 7, 8, 9 and 10 were each 0.5 g/m$^2$. Also, the coated gelatin amounts of the emulsion layers were all 2.5 g/m$^2$ and those of the protective layers were all 1.3 g/m$^2$.

Pieces of coating samples Nos. 3 to 10 thus prepared were exposed to light through a wedge, developed in the following developing solution A (a developing solution for an automatic developing processor) containing glutaraldehyde as dialdehyde hardener, at 35° C. for 25 seconds after exposed to light through a wedge with an automatic developing processor (FPM-4000 automatic developing processor produced by FUJI PHOTO FILM CO., LTD.) after the machine had be put in a running state by passing photographic light sensitive material there through. Thereafter the pieces were fixed, washed with water, dried and then subjected to sensitometry. Linearity of the characteristic curve was evaluated. Such evaluations were conducted in 5 steps, a 5 rating meaning that lumps did not appear at all in the medium concentration region of the characteristic curve and 1 meany that many such lumps appeared. In order to avaluate the granularity, the samples were also exposed to light through a wedge, and thereafter similar processings were conducted to measure RMS (root means square) granularity.

Formulation of the developing agent A

| | |
|---|---|
| Potassium hydroxide | 29.14 g |
| Glacial acetic acid | 10.96 g |
| Potassium sulfite | 44.20 g |
| Sodium bicarbonate | 7.50 g |
| Boric acid | 1.00 g |
| Diethyleneglycol | 28.96 g |
| Ethylenediaminetetraacetic acid | 1.67 g |
| 5-Methylbenztriazole | 0.06 g |
| 5-Nitroindazole | 0.25 g |
| Hydroquinone | 30.00 g |
| 1-Phenyl-3-pyrazolidone | 1.50 g |
| Glutaraldehyde | 4.93 g |
| Sodium metabisulfite | 12.60 g |
| Potassium bromide | 7.00 g |
| water to | 1 l |
| | pH 10.25 |

Furthermore, coating samples 3 to 10 were exposed to light through a wedge, developed in the following developing solution B (a developing solution for tray development) at 25° C. for 2 minutes, stopped, fixed, washed with water and dried, whereafter sensitometry was conducted. The sensitivity thus obtained was compared with that in the case where the above developing solution A was used.

Formulation of the developing solution B

| | |
|---|---|
| 1-phenyl-3-pyrazolidone | 0.5 g |
| Hydroquinone | 20.0 g |
| Disodium ethylenediaminetetraacetic acid | 2.0 g |
| Potassium sulfite | 60.0 g |
| Boric acid | 4.0 g |
| Potassium carbonate | 20.0 g |
| Sodium bromide | 5.0 g |
| Diethyleneglycol | 30.0 g |
| water to | 1 l |

The pH of the solution was adjusted to 10.0. Main results are shown in Table 3.

TABLE 3

| Coating sample No. | Emulsion | Photographic properties developing in developing solution A: Fog value | Maximum density | Evaluation of the shape of characteristic curve | RMS value D = 0.5 | Differences between sensitivity obtained by developing solution A and that by developing solution B* | |
|---|---|---|---|---|---|---|---|
| 3 | Emulsion 12 only | 0.10 | 1.25 | 1 | 0.050 | 0.52 | Comparative example |
| 4 | Emulsion 12 + Emulsion −1 | 0.10 | 1.25 | 1 | 0.049 | 0.51 | Comparative example |
| 5 | Emulsion 12 + Emulsion −3 | 0.07 | 1.32 | 3 | 0.040 | 0.43 | Comparative example |
| 6 | Emulsion 12 + Emulsion −6 | 0.04 | 1.40 | 5 | 0.030 | 0.31 | This invention |
| 7 | Emulsion 12 + Emulsion −7 | 0.04 | 1.42 | 5 | 0.027 | 0.30 | This invention |
| 8 | Emulsion 12 + Emulsion −9 | 0.07 | 1.30 | 3 | 0.042 | 0.45 | Comparative example |
| 9 | Emulsion 12 + Emulsion −10 | 0.07 | 1.30 | 3 | 0.040 | 0.45 | Comparative example |
| 10 | Emulsion 12 + Emulsion −11 | 0.09 | 1.25 | 2 | 0.048 | 0.50 | Comparative example |

*The difference was presented by log ratio B to A of necessary exposure amount to adjust to 0.5 higher than the fog value.

As is obvious from Table 3, highly improved effects were obtained in connection with fog, maximum density, shape of the characteristic curve and granularity in case where the emulsion of this invention was processed with the developing solution A. Using the emulsion of this invention, sensitivity differences between processing with the developing solution A and with the same solution B became small, so that variation of sensitivity depending on developing solution became small.

EXAMPLE 4

This example shows the effects obtained in the case where the emulsion of this invention is contained in the surface protective layer of light-sensitive materials having a light-sensitive silver halide emulsion layer.

Using thioether ($HO(CH_2)_2S(CH_2)_2S(CH_2)_2OH$), silver nitrate was reacted with potassium bromide and potassium iodide to prepare an emulsion containing tabular silver iodobromide grains (AgI: 3.5 mol%) having an average grain size of 1.6 micron and having a mean diameter by thickness (aspect ratio) of 12. The grains were de-salted by the conventional flocculation method and then chemically sensitized by gold-sulfur sensitization using chloroauric acid and sodium thiosulfate. To the grains, 4-hydroxy-6-methyl-1,3,3a,7-tetraazaindene was added as a stabilizer to prepare an emulsion No. 13 containing tabular light-sensitive $AgBr_{0.965}I_{0.035}$ grains. Dodecylbenzene sulfonate as a coating aid, polypotassium p-vinylbenzene sulfonate as a thickener, and N,N-ethylenebis-(vinylsulfonyl acetoamido) as a hardener were added to the emulsion to prepare an emulsion for coating.

The 9 samples of 8 wt% gelatin solution containing gelatin, a matt agent (poly-methylmethacrylate fine grains) and a coating aid (dodecylbenzene sulfonate) were prepared. Nothing was added to one of the samples, but emulsions Nos. 2, 3, 5, 7, 8, 9, 10 and 11 prepared in examples 1 and 2 were added to the other 8 samples in a constant amount to prepare coating solutions for preparation of the surface protective layer.

In the next stage, a coating solution containing emulsion No. 13 was used in every sample preparated and the above prepared various coating solutions for preparation of the surface protective layer were respectively coated in order on supports previously undercoated, so that coating samples Nos. 11 to 19 were obtained.

In all samples, the amount of coated silver of the emulsion layer was 3.9 g/m$^2$, the amounts of coated silver of emulsion Nos. 2, 3, 5, 7, 8, 9, 10 and 11 contained in the surface protective layer were 0.05 g/m$^2$, respectively, the amount of coated gelatin of the emulsion layer was 3.2 g/m$^2$, and the amount of coated gelatin of the surface protective layer was 1.2 g/m$^2$.

Coating samples Nos. 11 to 19 thus prepared were exposed to light through a wedge, developed in the developing solution A described in example 3 at 35° C. for 25 seconds, stopped, fixed, washed with water and dried. The same processing was also carried out using a developing solution in which 30 mg/l of KI was added to the developing solution A.

Sensitometry was conducted on these samples thus processed, to measure the increase in sensitivity resulting from the developing solution containing 30 mg/l of KI and increase in fog.

Furthermore, coating samples Nos. 11 to 19 having an area of 1,440 inch$^2$ were exposed to white light, respectively developed in the developing solution B described in example 3 at 20° C. for 4 minutes to measure the amount of iodide ion released in the developing solution during the development. The results obtained are shown in Table 4.

TABLE 4

| Coating samples No. | Emulsion of surface protective layer | Variation between developing solution containing KI and the same not containing KI: Sensitively* increase | Fog increase | Elution amount of $I^-$ in the developing solution B | |
|---|---|---|---|---|---|
| 11 | — | 0.10 | 0.20 | 35 (mg/l) | Comparative example |
| 12 | emulsion-2 | 0.09 | 0.18 | 31 | Comparative example |
| 13 | emulsion-3 | 0.08 | 0.16 | 27 | Comparative example |
| 14 | emulsion-5 | 0.01 | 0.05 | 10 | Present invention |
| 15 | emulsion-7 | 0.02 | 0.07 | 12 | Present invention |
| 16 | emulsion-8 | 0.04 | 0.09 | 15 | Present invention |
| 17 | emulsion-9 | 0.07 | 0.15 | 25 | Comparative example |
| 18 | emulsion-10 | 0.08 | 0.16 | 28 | Comparative example |
| 19 | emulsion-11 | 0.09 | 0.19 | 33 | Comparative example |

*Sensitivity increase is represented by log ($E_1/E_2$).
$E_1$: Amount of exposure needed to make the density 0.2 higher than Fog value where the developing solution A contains KI.
$E_2$: Amount of exposure needed to make the density 0.2 higher than Fog value where the developing solution A does not contain KI.

As is obvious from Table 4, coating samples Nos. 14 to 16 containing the emulsion of this invention exhibit effectively lower dependency on the concentration of iodide ion in the developing solution as well as effectively lower eluation of iodide ions from the samples of the developing solution.

EXAMPLE 5

Regarding the light-sensitive materials comprising photosensitive silver halide emulsion containing AgI described in U.S. Pat. No. 2,996,382 etc. and an internally fogged silver halide emulsion, this example shows the effects obtained in the case where the emulsion of this invention was used in an internally fogged silver halide emulsion.

According to the conventional ammonia method, silver nitrate was reacted with potassium bromide and potassium iodide to prepare an emulsion containing silver iodobromide (AgI: 4.0 mol%) grains having an average grain size of 0.9 micron. The grains were washed by the conventional flocculation method and then chemically sensitized by gold-sulfur sensitization using chloroauric acid and sodium thiosulfate. To the grains, 4-hydroxy-6-methyl-1,3,3a,7-tetraazaindene was added as a stabilizer to prepare a photosensitive silver iodobromide No. 14.

On the other hand, light was radiated onto emulsions Nos. 1 to 7, and 9 described in example 1 to prepare initially fogged emulsions Nos. 1′ to 7′ and 9′.

9 samples of emulsion No. 14 were prepared in an amount of 40 g respectively. Gelatin only was added to one sample while the 8 other samples were added with 10 g of initially fogged emulsions Nos. 1′ to 7′ and 9′, respectively. The amount of gelatin added to the first sample was similar to the amount of gelatin in the 10 g of emulsion added to the other samples. All emulsions used here were adjusted to the same mol number of silver halide per weight. To emulsions prepared by mixing gelatin or internally fogged emulsions Nos. 1′ to 7′ or 9′ with an emulsion No. 13, there were added dodecylbenzene sulfonate as a coating aid, polypotassium p-vinylbenzene sulfonate as a thickener, and N,N′-ethylenebis(vinyl-sulfonyl acetoamido) as a hardener to prepare coating solutions.

Such coating solutions and protective layer consisting of gelatin aqueous solution were separately coated in order on a support preveously undercoated to prepare coated samples Nos. 20 to 28. In all samples, the amount of coated silver of emulsion No. 14 was 2.0 g/m$^2$, the amount of coated silver of internally fogged emulsion Nos. 1′ to 7′ and 9′ was 0.5 g/m$^2$, the amount of coated gelatin in the emulsion layer was 1.8 g/m$^2$, and the amount of coated gelatin in the protective layer was 1.2 g/m$^2$.

Coated samples Nos. 20 to 28 thus prepared were exposed to light through a wedge and processed with the same automatic developing processor and a developing solution A described in example 3, whereafter sensitometry was conducted on these samples.

Additional coated samples Nos. 20 to 28 were developed in the developing solution B described in example 3 at 20° C. for 4 minutes, stopped, fixed, washed with water and dried, whereafter sensitometry was conducted on these samples to compare the variation is gradation with that by processing in said developing solution A.

The results of sensitometry using the developing solution A are shown in Table 5.

TABLE 5

| Coated sample No. | Emulsion | photographic properties: Relative sensitivity | Fog value | Gamma | Maximum density | |
|---|---|---|---|---|---|---|
| 20 | Emulsion No. 14 | 100 | 0.05 | 0.5 | 1.3 | Comparative example |
| 21 | Emulsion No. 14 + emulsion No. 1′ | 90 | 0.05 | 0.5 | 1.4 | Comparative |

TABLE 5-continued

| Coated sample No. | Emulsion | photographic properties Relative sensitivity | Fog value | Gamma | Maximum density | |
|---|---|---|---|---|---|---|
| | | | | | | example |
| 22 | Emulsion No. 14 + emulsion No. 2' | 105 | 0.05 | 0.7 | 1.8 | Comparative example |
| 23 | Emulsion No. 14 + emulsion No. 3' | 105 | 0.05 | 0.7 | 1.9 | Comparative example |
| 24 | Emulsion No. 14 + emulsion No. 4' | 110 | 0.07 | 0.7 | 1.8 | Comparative example |
| 25 | Emulsion No. 14 + emulsion No. 5' | 115 | 0.05 | 1.0 | 2.4 | This invention |
| 26 | Emulsion No. 14 + emulsion No. 6' | 115 | 0.05 | 1.0 | 2.4 | This invention |
| 27 | Emulsion No. 14 + emulsion No. 7' | 115 | 0.05 | 0.9 | 2.3 | This invention |
| 28 | Emulsion No. 14 + emulsion No. 9' | 105 | 0.05 | 0.7 | 1.8 | Comparative example |

*Relative sensitivity is based on the sensitivity of sample No. 20 as 100.

As is obvious from Table 5, samples Nos. 25 to 27 prepared by using the emulsion of this invention are superior to comparative samples Nos. 20 to 24 and 28 in connection with sensitivity, fog, gamma and maximum density.

Where the gamma of the samples were also measured according to same processing as set forth in example 3 in the developing solution B, the gamma of samples Nos. 25 to 27 of this invention was considerably lower than that of the comparative samples relative to dependence on developing solution.

As describe above, where halogen conversion-type emulsion is used, it considerably improves the iodide ions trapping power of the emulsion. It also enables the emulsion to easily form an internal latent image.

The halogen conversion-type emulsion is used with light-sensitive silver halide emulsion, so that it enables improvement of granularity and of dependence on formulation of developing solution. Furthermore, since the iodide ions trapping power of the emulsion of this invention is particularly high, dependence of formulation of developing solution can remarkably be reduced.

In addition to being usable as an internal latent image emulsion, the halogen conversion-type emulsion of this invention can be used as internally fogged with light-sensitive silver halide emulsion, where light-sensitived materials improved in connection with sensitivity, fog, gamma, maximum density etc. can be obtained.

What is claimed is:

1. Photographic light-sensitive material comprising a support and, located on the support, (A) at least one layer containing halogen conversion-type grains selected from the group consisting of halogen conversion-type silver chlorobromide grains, halogen conversion-type silver iodobromide grains and halogen conversion-type chloroiodobromide grains, the grains having substantially no surface sensitivity, the average grain size thereof being not more than 0.30 micron, and the grains containing from 0 to 2 mol% of silver iodide; and (B) at least one layer containing light-sensitive silver halides grains which contain 3 to 15 mol% of silver iodide, wherein the layers (A) and (B) are provided separately or combined into a single layer, and wherein the halogen conversion-type grains of (A) have a sensitivity of not more than 1/10 relative to the sensitivity of the light-sensitive silver halide grains of (B) and (A) has a coated silver amount of 0.2–20 weight % relative to the total coated silver amount of the light-sensitive silver halide grains of (B).

2. Photographic light-sensitive material as set forth in claim 1 wherein the layer of (A) is selected from the group consisting of surface protective layer, intermediate layer and emulsion layer.

3. Photographic light-sensitive material as set forth in claim 1 wherein the halogen conversion-type grains are not substantially chemically fogged.

4. Photographic light-sensitive material as set forth in claim 1 wherein the halogen conversion-type grains contain 0 to 2 mol% of AgI, 0 to 50 mol% of AgCl and 50 and 100 mol% of AgBr.

5. Photographic light-sensitive material as set forth in claim 1 wherein the halogen conversion-type grains of (A) have a sensitivity of not more than 1/100 relative to the sensitivity of the light-sensitive silver halide grains of (B).

6. Photographic light-sensitive material as set forth in claim 1 wherein the coated silver amount of (A) is 0.7–7 weight % relative to the total coated silver amount of the light-sensitive silver halide of (B).

7. Photographic light-sensitive material as set forth in claim 1 wherein said photographic light-sensitive material is a negative photographic light-sensitive material.

8. Photographic light-sensitive material as set forth in claim 1 wherein the halogen conversion-type grains are added to the light-sensitive silver halide emulsion layer (B) or to a layer located close to the layer (B).

9. Photographic light-sensitive material as set forth in claim 1 wherein the halogen conversion-type grains are internally fogged and the grains are added to the light-sensitive silver halide emulsion layer (B) or to a layer located close to the layer (B).

* * * * *